US007507138B2

(12) United States Patent
Chernick et al.

(10) Patent No.: US 7,507,138 B2
(45) Date of Patent: Mar. 24, 2009

(54) PLUSH TOY WITH ELASTOMERIC EXTREMITIES AND ITS METHOD OF FABRICATION

(76) Inventors: Mark J. Chernick, 19180 144th Ave., NE., Woodinville, WA (US) 98072; Webb T. Nelson, 19180 144th Ave., NE., Woodinville, WA (US) 98072

( * ) Notice: Subject to any disclaimer, the term of this patent is extended or adjusted under 35 U.S.C. 154(b) by 246 days.

(21) Appl. No.: 11/356,833

(22) Filed: Feb. 21, 2006

(65) Prior Publication Data

US 2007/0072515 A1 Mar. 29, 2007

Related U.S. Application Data

(63) Continuation-in-part of application No. 11/237,817, filed on Sep. 29, 2005.

(51) Int. Cl.
*A63H 3/00* (2006.01)

(52) U.S. Cl. ..... 446/268; 446/385; 446/369; 446/390

(58) Field of Classification Search ..... 446/385, 446/369, 390, 376, 268; 156/293, 294, 308.2, 156/308.4, 309.6, 93, 63
See application file for complete search history.

(56) References Cited

U.S. PATENT DOCUMENTS

| | | | | |
|---|---|---|---|---|
| 1,880,109 | A * | 9/1932 | Sanders | 446/376 |
| 4,369,284 | A | 1/1983 | Chen | 524/476 |
| 6,406,499 | B1 | 6/2002 | Kania | 623/36 |
| 6,461,214 | B1 * | 10/2002 | Lynch | 446/73 |
| 7,153,261 | B2 * | 12/2006 | Wenchell | 600/208 |

* cited by examiner

*Primary Examiner*—Gene Kim
*Assistant Examiner*—Urszula M Cegielnik
(74) *Attorney, Agent, or Firm*—LaMorte & Associates, P.C.

(57) ABSTRACT

A toy figure assembly and its method of manufacture. The toy figure has a plush body made from segments of fabric that are sewn together along seams. The plush body defines an interior region that can be accessed through at least one opening. At least one stretchable extremity is provided. The stretchable extremities serve as the limbs of the toy figure, or another body feature. Each of the stretchable extremities has a first end and a second end. Each stretchable extremity extends through at least one opening in the plush body. Accordingly, each of the stretchable extremities has a second end that is inside the plush body and a first end that extends outside the plush body. A fabric flap is bonded to each stretchable extremity proximate its second end. The fabric flap is sewn to at least one of the seams within the interior of the plush body.

11 Claims, 3 Drawing Sheets

PLUSH TOY WITH ELASTOMERIC EXTREMITIES AND ITS METHOD OF FABRICATION

RELATED APPLICATIONS

This application is a continuation-in-part of co-pending U.S. patent application Ser. No. 11/237,817, entitled Toy Figure That Combines Plush Construction With Elastomeric Gel, which was filed Sep. 29, 2005,

BACKGROUND OF THE INVENTION

1. Field of the Invention

In general, the present invention relates to manufacturing techniques used in the fabrication of toy figures. More particularly, the present invention relates to techniques used to combine fabric construction materials with synthetic elastomeric construction materials to produce figures that embody different physical characteristics.

2. Prior Art Description

In the toy industry, "plush toys" is the name used to describe toys with a fabric-based construction. Such toys include stuffed animals, dolls and the like. Traditionally plush toys are made by sewing together a fabric shell from some type of material, such as cotton or synthetic fur. The fabric shell defines the external shape of the toy. The fabric shell is then stuffed with polyester fibers of some similar type of stuffing material. Hard objects, such as button eyes, can then be either sewn or glued to the exterior of the fabric shell.

Throughout the long history of plush toys, there have many occasions where toy manufacturers have attempted to make toy figures that have both soft plush features and hard non-plush features. For instance, there are many dolls that have hard porcelain heads and hands, but the remainder of the doll is made with traditional plush fabric material. In order to join hard components, such as a doll head to a plush fabric body, the hard component is typically made with a grooved base. The fabric material of the plush section is passed around the grooved base and tightened with thread. The fabric material tightens within the groove, therein creating a mechanical interconnection between the plush section of the toy and the non-plush sections.

As the materials of toys evolved, many toys began to be manufactured from different types of plastic, rather than fabric. For instance, many dolls have bodies made from hard plastic. The heads of the dolls, however, are often molded from a softer more pliable plastic. Although plastic is used, the type of connections between the two different types of plastic parts remains traditional. Typically, the toy part made from the harder plastic is molded with a grooved base. The toy part made from the softer plastic is made with an opening that can be stretched around the grooved base. When the opening of softer plastic contracts into the groove of the harder plastic, a mechanical interconnection is created that joins the plastic sections.

In the toy industry, elastomeric gels are becoming increasingly popular. Elastomeric gels are triblock copolymer plastics that have been mixed with a plasticizing oil to form an elastic gel. Elastomeric gels embody a high degree of elasticity and a high resistance to tearing that make such gels useful in toy manufacturing. There are currently several elastomeric gels that are commercially available. One of the earliest elastomeric gels is exemplified by U.S. Pat. No. 4,369,284 to Chen, entitled Thermoplastic Elastomer Gelatinous Compositions.

Elastomeric gels are typically molded into toys such as balls and flying discs using traditional injection molding techniques. The use of injection molding techniques prohibits elastomeric gels from being molded directly onto a non-plastic plush form. In industry, elastomeric gels have been applied to fabric objects, such as socks, in order to provide cushioning. Consider U.S. Pat. No. 6,406,499 to Kania, entitled Gel And Cushioning Devices. However, in such applications the fabric body is dipped into a vat of molten elastomeric gel material. The elastomeric gel material is then given time to cure upon the fabric body.

A problem occurs when a toy manufacturer desires to create a figure that is part plush and part elastomeric gel. Traditional mechanical attachment techniques do not work. Since the elastomeric gel is so elastic, it easily pulls away from any sort of grooved connection base it may be stretched across. Furthermore, elastomeric gels cannot be molded onto plush toys, nor can elements of a plush toy figure be created by molten dipping. The only solution to date has been to glue elastomeric gel material to fabric using traditional acrylic based glues. However, since the traditional acrylic glues harden when they cure, the glues quickly peel away from the elastomeric gel as the elastomeric gel stretches and deforms under the hardened glue. The component of the toy made from the elastomeric gel, therefore, quickly peels away from the remainder of the toy, where it can become a choking hazard.

A need therefore exists for an improved technique for joining elastomeric gels to the fabric shell of an otherwise plush toy. This need is met by the present invention as is described and claimed below.

SUMMARY OF THE INVENTION

The present invention is a toy figure assembly and its method of manufacture. The toy figure has a plush body made from segments of fabric that are sewn together along seams. The plush body defines an interior region that can be accessed through at least one opening that is formed in the plush body.

At least one stretchable extremity is provided. The stretchable extremities can serve as the limbs of the toy figure, or another body feature. Each of the stretchable extremities has a first end and a second end. Each stretchable extremity extends through at least one opening in the plush body. Accordingly, each of the stretchable extremities has a second end that is inside the plush body and a second end that extends outside the plush body.

A fabric flap is bonded to each stretchable extremity proximate its second end. The fabric flap is sewn to at least one of the seams within the interior of the plush body.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

There are countless varieties of plush toys. The present invention is described using one exemplary configuration of a plush toy. This configuration is intended to be merely exemplary of any plush toy configuration and should not be considered to limit the application of the present invention to other plush toy configurations.

Figure 1:
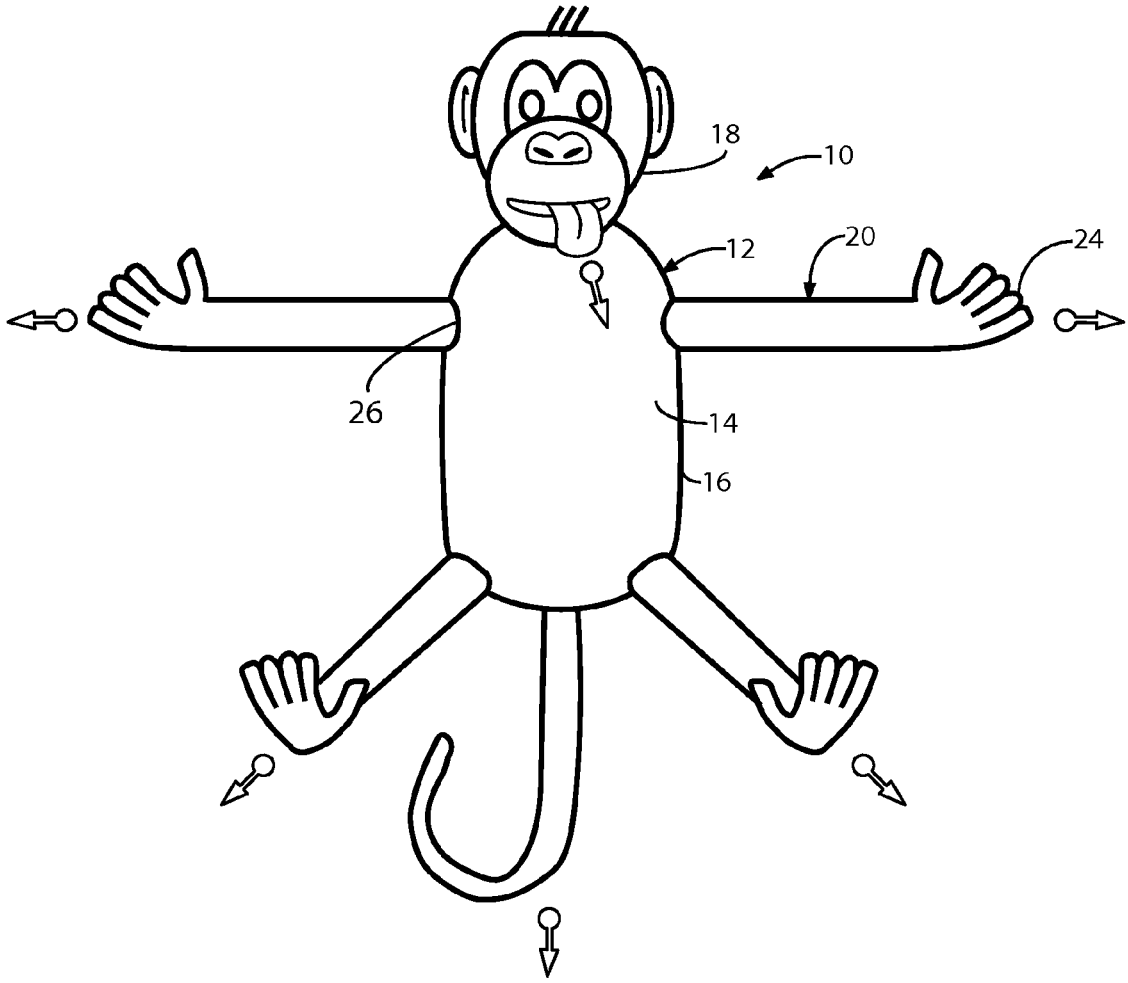
FIG. 1 is a front view of an exemplary toy figure.

Referring to FIG. 1, there is shown a toy FIG. 10. The toy FIG. 10 has a plush section 12 made in the traditional manner. The plush section 12 is made from a sewn fabric shell 14 that is stuffed with dry fill material, such as polyester fibers. In the shown embodiment, the toy FIG. 10 is a stuffed monkey. The plush section 12 of the monkey includes both the body 16 and the head 18 of the toy FIG. 10.

The toy FIG. 10 also has at least one stretchable extremity 20 that is made from an elastomeric gel. In the shown embodiment, the stretchable extremities 20 include arms, legs, tail and tongue. However, such a selection of extremities is merely exemplary and it will be understood that, depending upon the motif of the toy, the extremities could include ears, noses, tusks, horns, wings and the like.

Figure 2:
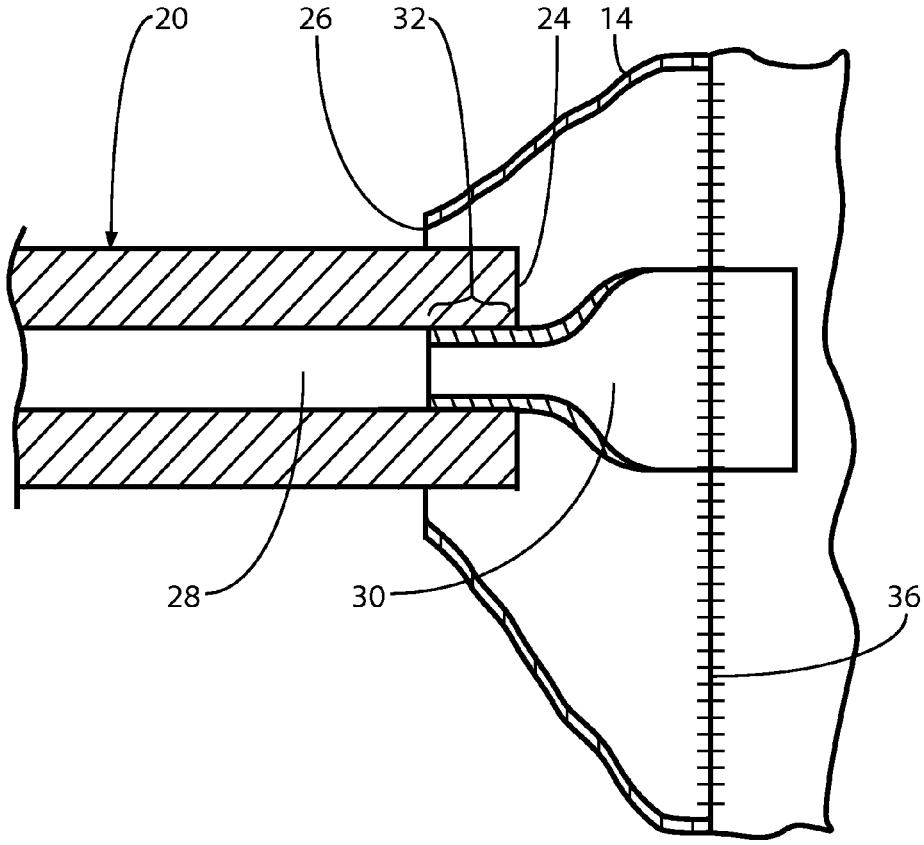
FIG. 2 is a cross-sectional view of a portion of the exemplary toy figure of FIG. 1.

Each of the stretchable extremities 20 is highly elastic. Accordingly, each of the stretchable extremities 20 can be stretched to a length at least twice as long as its original length. Each stretchable extremity 20 is elongated in shape and has two opposing ends 22, 24 (FIG. 2). The first end 22 of each stretchable extremity 20 is the visible end that hangs freely on the outside of the toy FIG. 10. The second end 24 (FIG. 2) of each elastomeric extremity 20 cannot be seen. Rather, the second end 24 (FIG. 2) of each stretchable extremity 20 passes into the plush section 12 of the toy FIG. 10 and is hidden from view.

Openings 26 are formed into the structure of the plush section 12 of the toy FIG. 10. The stretchable extremities 20 pass into these openings and are internally attached to the plush section 12 of the toy FIG. 10.

Figure 3:
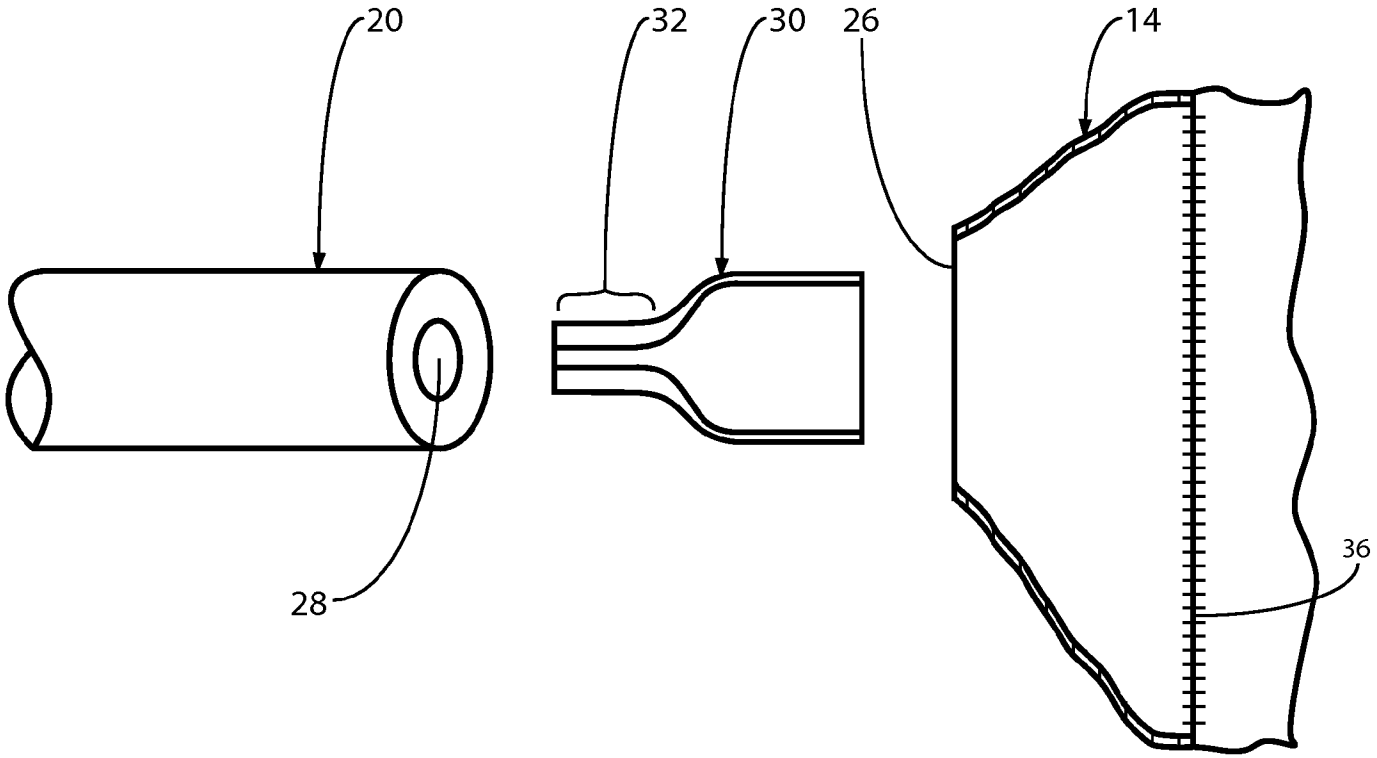
FIG. 3 is an exploded view of the elements shown in FIG. 2.

Referring to FIG. 2 and FIG. 3, the second end 24 of a stretchable extremity 20 is shown. The stretchable extremity 20 can be an arm, leg, or any other type of extremity that has been previously mentioned. The stretchable extremity 20 is tubular in its construction near the second end 24. Accordingly, the stretchable extremity 20 defines a central conduit 28. The presence of the central conduit 28 reduces the weight and cost of the stretchable extremity 20. It also makes the stretchable extremity 20 more elastic so it can be stretched longer distances with less force.

The stretchable extremity 20 is made by the injection molding of the appropriate triblock copolymer materials. Since the stretchable extremity is made from elastomeric gel, it is highly elastic and resistant to tearing.

A fabric flap 30 is provided. The fabric flap 30 is made from a strong, woven material, such as canvas. One section of the fabric flap 30 is rolled into a cylindrical shape. The cylindrical section 32 of the fabric flap 30 is inserted into the central conduit 28 at the second end 24 of the stretchable extremity 20. Once the cylindrical section 32 is inserted into the central conduit 28, the cylindrical section 32 of the fabric flap 30 is heat bonded to the material of the stretchable extremity 20.

The heat bonding of the fabric flap 30 to the stretchable extremity 20 can be done in one of two ways. First, the stretchable extremity 20 can be completely molded. The cylindrical section 32 of the fabric flap 30 can then be inserted into the central conduit 28 at the second end 24. A heating element can then be inserted into the cylindrical section 32. The heating element melts the surrounding elastomeric material until that material flows into the weave of the fabric flap 30. The heating element is then removed and the elastomeric material hardens. Once hardened, the cylindrical section 32 of the fabric flap 30 is enmeshed in the material of the stretchable extremity 20 and cannot be removed.

In a second manufacturing technique, the stretchable extremity 20 can be partially molded in an injection molding machine. Once formed into the desired shape, the fabric flap 30 can be introduced into the injection mold, prior to the final curing of the elastomeric material. The uncured elastomeric material flows into the weave of the fabric flap 30 prior to curing. When the stretchable extremity 20 is removed from the molding machine, the fabric flap 30 is permanently affixed to the elastomeric material.

The plush section 12 of the toy FIG. 10 is made from various pieces of fabric that are sewn together to form the fabric shell 14. The fabric shell 14 is then stuffed to provide volume and weight to the overall plush section 12. In the shown embodiment, the plush section 12 of the toy FIG. 10 is made with access openings 26. The access openings 26 lead into the interior of the toy FIG. 10. Since the plush section 12 is sewn together, there are various seams 36 present along the exterior and interior surfaces of the plush section 12. The portion of the fabric flap 30 that extends from the stretchable extremity 20 is sewn to the plush section 12, preferably along one of the existing seams 36.

Once the fabric flap 30 is sewn to the plush section 12 of the toy FIG. 10, the fabric flap 30 mechanically connects the stretchable extremity 20 to the plush section 12 of the toy FIG. 10. The fabric flap 30 is sewn to the plush section 12 of the toy FIG. 10 within the interior of the plush section 12. Consequently, the point of attachment cannot be seen. Rather, a consumer would only see the stretchable extremities 20 of the toy FIG. 10 pass into the plush section 12 of the toy FIG. 10 and remain firmly affixed to the plush section 12 even when the stretchable extremities 20 are pulled and elongated.

The embodiment of the present invention illustrates a new toy figure construction. The toy figure has external portions that are made of traditional plush construction and extremities that are made from elastomeric gel. The toy figure, therefore, will have external portions that vary greatly in physical characteristics.

It will be understood that the embodiment illustrated is merely exemplary and that a person skilled in the art can make alternate embodiments without departing from the principals of the invention. The toy figure can take any shape. It can be a person, an animal or an inanimate object. The shape of the toy figure is a matter of design choice. What is important is that elastomeric material and fabric material are both used to create the toy figure. The elastomeric material is not separate from the plush construction, but rather the elastomeric material and the fabric material are integrated to form a toy figure with unique physical characteristics. Accordingly, variations, modifications and alternate embodiments of the illustrated embodiment are intended to be covered by the scope of the claims as defined below.

What is claimed is:

1. A method of attaching an elastomeric limb to a plush toy body, said method comprising the steps of:

providing a plush toy body having an interior region that is accessible through openings in said plush toy body;

providing a limb molded from elastomeric material, wherein said limb has a first end and a second end;

bonding a fabric flap to said second end of said limb;

positioning said second end of said limb inside said interior region of said plush toy body, wherein said limb extends of said interior region through said one of said openings; and sewing said fabric flap to said interior region of said plush toy body.

2. The method according to claim 1, wherein said second end is tubular in its construction and defines a central conduit.

3. The method according to claim 2, wherein said step of bonding a fabric flap to said limb includes inserting a portion of said fabric flap into said central conduit and heat bonding said fabric flap to said limb within said central conduit.

4. The method according to claim 1, wherein said step of providing a plush toy body includes providing a toy body made from segments of fabric sewn together along seams.

5. The method according to claim 4, wherein said step of sewing said fabric flap to said interior region of said plush toy body includes sewing said fabric flap to at least one of said seams.

6. A method of fabricating a toy figure, comprising the steps of:

creating a plush body from segments of material sewn together along seams, wherein said plush body defines an interior area and an opening for accessing said interior area;

providing an extremity made from elastomeric gel, said extremity having a first end and an opposite second end;

inserting said second end of said extremity through said opening so that said second end of said extremity is within said interior area and said first end of said extremity is not; and attaching said second end of said extremity to one of said seams of said plush body within said interior area.

7. The method according to claim 6, further including the step of attaching a fabric flap to said second end of said extremity.

8. The method according to claim 7, wherein said step of attaching a fabric flap to said second end of said extremity includes heat bonding said fabric flap to said extremity.

9. The method according to claim 7, wherein said step of providing an extremity includes providing an extremity with a tubular second end that defines a central conduit.

10. The method according to claim 9, wherein said step of attaching a fabric flap to said second end of said extremity includes heat bonding a portion of said fabric flap to said extremity within said central conduit.

11. The method according to claim 8, wherein said step of attaching said second end of said extremity to said plush body includes sewing said fabric flap to one of said seams within said interior area.

* * * * *